United States Patent [19]

Grünwald et al.

[11] Patent Number: 4,475,491

[45] Date of Patent: Oct. 9, 1984

[54] WIDE-GAP IGNITION DISTRIBUTOR

[75] Inventors: Werner Grünwald, Gerlingen; Jurgen Schmatz, Ludwigsburg, both of Fed. Rep. of Germany

[73] Assignee: Robert Bosch GmbH, Stuttgart, Fed. Rep. of Germany

[21] Appl. No.: 407,314

[22] Filed: Aug. 12, 1982

[30] Foreign Application Priority Data

Sep. 16, 1981 [DE] Fed. Rep. of Germany ..... 3136745

[51] Int. Cl.[3] ..... F02P 1/00

[52] U.S. Cl. ..... 123/146.5 A; 200/266; 200/19 DR; 200/19 DC

[58] Field of Search ..... 123/146.5 A; 200/19 R, 200/19 DR, 19 DC, 266

[56] References Cited

U.S. PATENT DOCUMENTS

| | | | |
|---|---|---|---|
| 4,007,342 | 2/1977 | Makino | 123/146.5 A |
| 4,074,090 | 2/1978 | Hayashi | 123/146.5 A |
| 4,091,245 | 5/1978 | Komiyama | 123/146.5 A |
| 4,208,554 | 6/1980 | Sprague | 123/146.5 A |
| 4,217,470 | 8/1980 | Kirner | 123/146.5 A |
| 4,308,436 | 12/1981 | Sone et al. | 200/19 R |
| 4,332,988 | 6/1982 | Dungan | 123/146.5 A |
| 4,354,070 | 10/1982 | Sone et al. | 123/146.5 A |
| 4,409,295 | 10/1983 | Smith et al. | 200/266 |

*Primary Examiner*—Ronald B. Cox

*Attorney, Agent, or Firm*—Frishauf, Holtz, Goodman & Woodward

[57] ABSTRACT

In order to make possible the lower level of electrostatic disturbance that accompanies the use of a wider than usual gap in an ignition distributor without undesirable increase of the ignition pulse voltage, the distributor electrode and/or the fixed ignition circuit electrodes of the distributor are made at least in part of a material that requires less energy for pulling out an electron and has a higher secondary electron emission capability than the usual brass plate used for the contact plate at the axis of revolution of the distributor rotor, to which a carbon brush is usually provided for making contact. Alloy additions of calcium oxide or barium oxide or silicon to brass have a suitable effect and an alloy containing silicon and preferably also aluminum and calcium is preferred. The gap width is between 3 and 5 mm, preferably about 4 mm for normal motor vehicle engine application.

21 Claims, 1 Drawing Figure

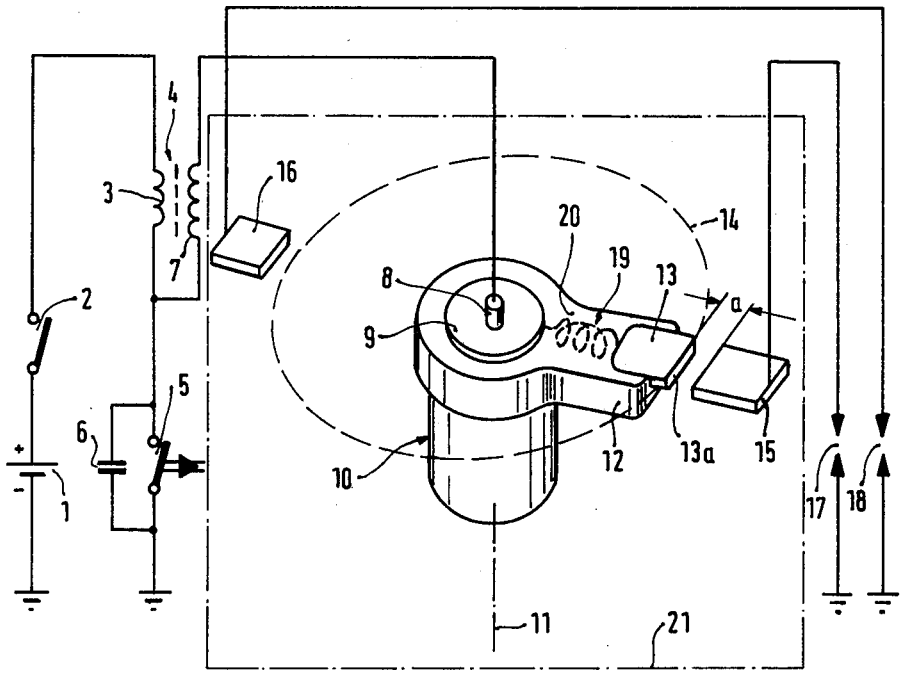
4
3
16
7
2
5
6
+
-
1
20
19
14
8
13
a
9
10
12
13a
15
17
18
11
21

WIDE-GAP IGNITION DISTRIBUTOR

This invention concerns an ignition distributor for internal combustion engines in which an engine driven rotor revolves so that its extremity passes by fixed ignition circuit electrodes in turn, the rotor carrying an electrode connected through a resistance for suppressing disturbances to a central contact, allowing an arc to form across the gap between a fixed electrode and the rotor as the latter passes by.

In such ignition distributors the spacing between the revolving distributor electrode and the fixed electrode involves a problem in that enlargement of the spacing improves operation by reducing high frequency disburbances but requires substantial increase of the ignition voltage, which makes increased insulation expense necessary and involves larger energy losses as well as increased thermal stress of the operating components of the distributor.

German Pat. No. 1 948 265 shows a distributor for internal combustion engines in which the spacing between the distributor electrode and the fixed electrode that it passes by is proposed to be in the range between 1.52 and 6.35 mm, but this disclosure has had little if any effect on the practical art because of the disadvantage of higher voltage, higher energy loss and higher heat evolution.

THE INVENTION

It is an object of the present invention to provide an ignition distributor operating with a wide gap between the distributor electrode and the fixed electrode without the disadvantages above mentioned.

Briefly, the spacing between the fixed ignition electrodes and the distributor contact during the closest approach of the latter to the former is between 3 and 5 mm and the distributor electrode, at least in an exposed region thereof, consists of a material having a substantially lower electron ignition energy requirement (work function) and a higher secondary electron ignition capability than the material of the contact plate at the center of the distributor rotor to which the connection is made to supply the high voltage pulses to the rotary gap. Alternatively, the fixed electrodes, rather than the distributor electrode, or both of them, consist at least in an exposed region thereof, of a material having a substantially lower electron ignition energy requirement and a higher secondary electron ignition capability than the material of the aforesaid contact plate.

In particular, the material of lower electron ignition energy requirement above mentioned is preferably a silicon containing alloy. A silicon containing alloy which also contains aluminum or one which contains both aluminum and calcium are preferred.

The alloy may be made, for example, by alloying silicon powder into brass to the extent of between 25 to 35% silicon by weight, preferably about 30%. It can likewise be advantageously made by alloying silicon powder in the same percentage by weight into aluminum or into an alloy of aluminum and calcium, for example to produce an alloy containing approximately 30% silicon, 55% aluminum and 15% calcium. Another useful embodiment of the invention involves the use of an alloy for the distributor contact and/or the fixed contacts containing between 30 and 36% silicon (preferably 33%), between 62 and 68% calcium (preferably 65%) and a residue of about 2% by weight consisting of aluminum carbon or predominantly of aluminum. Still another material for the distributor electrode and/or the fixed ignition electrode, is a metalic material having a coating of a sodium-containing salt.

THE DRAWING

The invention is further described by way of illustrative example with reference to the annexed drawing, in the single FIGURE of which there is diagramatically shown a perspective use of the rotor and two fixed ignition electrodes of a distributor according to the invention, together with a circuit diagram.

DESCRIPTION OF THE ILLUSTRATED EMBODIMENT

The ignition system as schematically shown in the drawing is intended for service in an internal combustion engine, particularly for the drive engine of a motor vehicle. This ignition system is supplied with energy from a DC current source 1, which can for example be the storage battery of the motor vehicle. The current source 1 has its negative pole connected to ground or vehicle chassis and its positive pole connected to the usual ignition switch 2 from which a conductor continues to the primary winding 3 of an ignition coil 4. The end of the winding 3 opposite to the one to which the ignition switch 2 is connected is the point of beginning for a circuit branch leading to "ground" which contains a parallel combination of an interrupter switch 5 and a disturbance suppressing capacitor 6. The end of the primary winding 3 opposite connected to the ignition switch 2 is also the point of beginning for a connection that runs through the secondary winding 7 belonging to the ignition coil 4 to a sliding contact 8. This sliding contact 8 represents the conventional carbon contact pressing on a contact plate 9 and seated centrally in a high voltage internal projection of an ignition distributor cap not shown in the drawing and subjected to spring pressure. The contact plate 9 is located on the upper face of an insulating body 10 which is capable of being put into rotation by means of a distributor shaft 11 indicated only with a dot-dash line, the connection to the shaft usually being subject to interposition of a centrifugal force timing shift device.

The insulating body 10 has a radially projecting finger 12 at the free end of which the distributor electrode 13 is set in place. Upon rotation of the insulating body 10 the free end **13*a* of the distributor electrode 13 is moved in a circular path of revolution in which it passes closely by each of several fixed electrodes 15, 16, in each case after running through particular sectors of angle of rotation. In the illustrated case the electrode 13 passes by the electrodes 15 and 16** respectively at a spacing of much more than the conventional maximum of 1.5 mm.

The fixed electrode 15 has a connection to ground through a spark plug 17 and, likewise, the fixed electrode 16 has one through a spark plug 18. Between the contact plate 9 and the distributor electrode 13 a disturbance suppression resistor 19 is physically and electrically interposed which in the preferred case is a wire spiral operating as a high frequency choke.

The equipment serving for ignition distribution is framed by the dot-dash line 21 to distinguish it from the rest of the circuit.

When, after the ignition switch 2 is closed and the engine therefore put into operation, the interrupter switch 5 is put into its blocking (open) condition, an ignition voltage pulse induced in the secondary 7 as a result of the interruption of the current theretofore supplied to the primary winding 3. The high voltage pulse thus produced proceeds in sequence to the component 8, 9, 19 and 13 and strikes through as a discharge to one of the fixed electrodes 15 and 16 in order to enable the generation and ignition spark at the corresponding spark plug 17 or 18, as the case may be.

In order to obtain good suppression of high frequency disturbances, in the illustrated case, the spacing between the distributor electrode 13 and each of the fixed electrodes 15 and 16 at closest approach by the distributor electrode lies between 3 and 5 mm, preferably about 4 mm. In order to avoid, according to the invention, the raising of the ignition pulse and distributor arc voltage because of the relatively high electrode spacing, the distributor electrode 13 and/or the fixed electrodes 15 and 16 consists, at least in an exposed region thereof, of a special material that, in comparison to the material of the contact plate 9 that is usually of brass, requires less energy for the pulling out of an electron (work function) and has a higher secondary electron emission.

In the simplest case it would be sufficient to make the distributor electrode 13 and/or the fixed electrodes 15 and 16 out of brass and then to alloy calcium oxide or barium oxide in the region where the distributor electrode and the fixed electrode face each other.

Good results have been found if the special material is an alloy that contains silicon. Thus, for example, good results have been obtained with a material made by alloying between 25 and 35% by weight, preferably about 30%, of silicon powder into brass.

Good results are also obtained if the special material of lower work function is an alloy that contains aluminum as well as silicon. Thus it is effective to use an alloy made by alloying in between 25 and 35% by weight, preferably about 30%, of silicon powder into aluminum.

In the preferred case the alloy providing special material of low work function also contains calcium in addition to silicon and aluminum. Good results have been obtained with an alloy containing about 30% by weight of silicon, about 55% by weight aluminum and about 15% by weight of calcium and such results are to be expected when the silicon content is between 25 and 35%, aluminum between 50 and 60% and calcium between 12 and 18%, by weight. Still better results have been obtained with an alloy composed of about 33% by weight of silicon and about 65% by weight of calcium, with the remaining 2% or so consisting of aluminum or, preferably, aluminum and carbon. Such results are to be expected where the silicon content is between 30 and 36% by weight, the calcium content between 62 and 68% by weight and the combined silicon and calcium content between 97 and 98.5% by weight.

In all cases an increased effect in reducing the energy necessary for pulling electrons out of the material is obtained when the special material is provided with a coating of a sodium containing salt and of course such a coating should be adherent to the metalic underlying material in order to obtain long service life. Such a coating has some useful effect according to the invention even if the coated electrode is simply of brass containing a little CaO or BaO.

Although the invention has been described with reference to a particular illustrative embodiments, it will thus be recognized that considerable variations and modifications are possible within the inventive concept.

We claim:

1. Ignition distributor for internal combustion engines having an engine driven rotary shaft, a rotor affixed thereto having a radial extremity provided for revolving in a path passing by an array of fixed ignition circuit electrodes, a distributor electrode at said extremity of said rotor, a contact plate on said rotor at the center of said pattern of revolution of said rotor extremity, means for connecting said contact plate to a source of ignition pulses, an insulating rotor body for carrying said contact plate and said distributor electrode, means including interference-suppression impedance for electrically connecting said distributor electrode to said contact plate, and the improvement, according to the invention wherein:

the spacing between said fixed ignition electrodes and said distributor contact during the closest approach of the latter to the former is between 3 and 5 millimeters, and said fixed ignition electrodes, at least in an exposed region thereof, consist of an alloy containing silicon, aluminum and calcium having a substantially lower electron emission energy requirement and a higher secondary electron emission capability than the material of said contact plate.

2. Ignition distributor for internal combustion engines having an engine driven rotary shaft, a rotor affixed thereto having a radial extremity provided for revolving in a path passing by an array of fixed ignition circuit electrodes, a distributor electrode at said extremity of said rotor, a contact plate on said rotor at the center of said patern of revolution of said rotor extremity, means for connecting said contact plate to a source of ignition pulses, an insulating rotor body for carrying said contact plate and said distributor electrode, means including interference-suppression impedance for electrically connecting said distributor electrode to said contact plate, and the improvement, according to the invention wherein:

the spacing between said fixed ignition electrodes and said distributor contact during the closest approach of the latter to the former is between 3 and 5 millimeters, and said distributor electrode, at least in an exposed region thereof, consists of an alloy containing silicon, aluminum and calcium and having a substantially lower electron emission energy requirement and a higher secondary electron emission capability than the material of said contact plate.

3. Ignition distributor for internal combustion engines having an engine driven rotary shaft, a rotor affixed thereto having a radial extremity provided for revolving in a path passing by an array of fixed ignition circuit electrodes, a distributor electrode at said extremity of said rotor, a contact plate on said rotor at the center of said pattern of revolution of said rotor extremity, means for connecting said contact plate to a source of ignition pulses, an insulating rotor body for carrying said contact plate and said distributor electrode, means including interference-suppression impedance for electrically connecting said distributor electrode to said contact plate, and the improvement, according to the invention wherein:

the spacing betwen said fixed ignition electrodes and said distributor contact during the closest approach of the latter to the former is between 3 and 5 millimeters, and said distributor electrode, at least in an exposed region thereof, consists of an alloy containing silicon and aluminum made by alloying silicon powder into aluminum to the extent of between 25 and 35% of silicon by weight and having a substantially lower electron emission energy requirement and a higher secondary electron emission capability than the material of said contact plate.

4. Ignition distributor for internal combustion engines having an engine driven rotary shaft, a rotor affixed thereto having a radial extremity provided for revolving in a path passing by an array of fixed ignition circuit electrodes, a distributor electrode at said extremity of said rotor, a contact plate on said rotor at the center of said pattern of revolution of said rotor extremity, means for connecting said contact plate to a source of ignition pulses, an insulating rotor body for carrying said contact plate and said distributor electrode, means including interference-suppression impedance for electrically connecting said distributor electrode to said contact plate, and the improvement, according to the invention wherein:

the spacing between said fixed ignition electrodes and said distributor contact during the closest approach of the latter to the former is between 3 and 5 millimeters, and said distributor electrode, at least in an exposed region thereof, consists of a material having a substantially lower electron emission energy requirement and a higher secondary electron emission capability than the material of said contact plate, said material of lower electron emission energy requirement being a metallic material having an adherent coating of a sodium-containing salt.

5. Ignition distributor for internal combustion engines having an engine driven rotary shaft, a rotor affixed thereto having a radial extremity provided for revolving in a path passing by an array of fixed ignition circuit electrodes, a distributor electrode at said extremity of said rotor, a contact plate on said rotor at the center of said pattern of revolution of said rotor extremity, means for connecting said contact plate to a source of ignition pulses, an insulating rotor body for carrying said contact plate and said distributor electrode, means including interference-suppression impedance for electrically connecting said distributor electrode to said contact plate, and the improvement, according to the invention wherein:

the spacing between said fixed ignition electrodes and said distributor contact during the closest approach of the latter to the former is between 3 and 5 millimeters, and said fixed ignition electrodes, at least in an exposed region thereof, consist of a material having a substantially lower electron emission energy requirement and a higher secondary electron emission capability than the material of said contact plate, said material of lower electron emission energy requirement being a metallic material having an adherent coating of a sodium-containing salt.

6. Ignition distributor for internal combustion engines having an engine driven rotary shaft, a rotor affixed thereto having a radial extremity provided for revolving in a path passing by an array of fixed ignition circuit electrodes, a distributor electrode at said extremity of said rotor, a contact plate on said rotor at the center of said pattern of revolution of said rotor extremity, means for connecting said contact plate to a source of ignition pulses, an insulating rotor body for carrying said contact plate and said distributor electrode, means including interference-suppression impedance for electrically connecting said distributor electrode to said contact plate, and the improvement, according to the invention wherein:

the spacing between said fixed ignition electrodes and said distributor contact during the closest approach of the latter to the former is between 3 and 5 millimeters, and said fixed ignition electrodes, at least in an exposed region thereof, consist of an alloy containing silicon and aluminum made by alloying silicon powder into aluminum to the extent of between 25 and 35% of silicon by weight and having a substantially lower electron emission energy requirement and a higher secondary electron emission capability than the material of said contact plate.

7. Ignition distributor as defined in claim 2 in which also said fixed ignition electrodes, at least in an exposed region thereof, consist of an alloy containing silicon, aluminum and calcium having a substantially lower electron emission energy requirement and a higher secondary electron emission capability than the material of said contact plate.

8. Ignition distributor as defined in claim 2 in which said alloy contains between 25 and 35% silicon, between 40 and 60% aluminum and between 12 and 18% calcium.

9. Ignition distributor as defined in claim 8 in which said alloy contains approximately 30% silicon, 55% aluminum and 15% calcium.

10. Ignition distributor as defined in claim 2 in which said alloy contains, by weight, between 30 and 36% silicon and between 62 and 68% calcium, the total content of silicon and calcium amounting to between 97 and 98.5% of the alloy by weight, the remainder consisting of aluminum and carbon.

11. Ignition distributor as defined in claim 10, in which said alloy contains by weight approximately 33% silicon and 65% calcium.

12. Ignition distributor as defined in claim 2 in which said alloy contains, by weight, between 30 and 36% silicon and between 62 and 68% calcium, the total content of silicon and calcium amounting to between 97 and 98.5% of the alloy by weight, the remainder consisting predominantly of aluminum.

13. Ignition distributor as defined in claim 11, in which said alloy contains by weight approximately 33% silicon and 65% calcium.

14. Ignition distributor as defined in claim 4 in which also said fixed ignition electrodes, at least in an exposed region thereof, consist of a material having a substantially lower electron emission energy requirement and a higher secondary electron emission capability than the material of said contact plate, said last-mentioned material of lower electron emission energy requirement being a metallic material having an adherent coating of a sodium-containing salt.

15. Ignition distributor as defined in claim 3 in which also said fixed ignition electrodes, at least in an exposed region thereof, consist of an alloy containing silicon and aluminum made by alloying silicon powder into aluminum to the extent of between 25 and 35% of silicon by weight and having a substantially lower electron emission energy requirement and a higher secondary electron emission capability than the material of said contact plate.

16. Ignition distributor as defined in claim 1 in which said alloy contains between 25 and 35% silicon, between 40 and 50% aluminum and between 12 and 18% calcium.

17. Ignition distributor as defined in claim 16 in which said alloy contains approximately 30% silicon, 55% aluminum and 15% calcium.

18. Ignition distributor as defined in claim 1 in which said alloy contains, by weight, between 30 and 36% silicon and between 62 and 68% calcium, the total content of silicon and calcium amounting to between 97 and 98.5% of the alloy by weight, the remainder consisting of aluminum and carbon.

19. Ignition distributor as defined in claim 18 in which said alloy contains by weight approximately 33% silicon and 65% calcium.

20. Ignition distributor as defined in claim 1 in which said alloy contains, by weight, between 30 and 36% silicon and between 62 and 68% calcium, the total content of silicon and calcium amounting to between 97 and 98.5% of the alloy by weight, the remainder consisting predominantly of aluminum.

21. Ignition distributor as defined in claim 19 in which said alloy contains, by weight, approximately 33% silicon and 65% calcium.

* * * * *